US011582544B2

(12) United States Patent
Schuler et al.

(10) Patent No.: US 11,582,544 B2
(45) Date of Patent: Feb. 14, 2023

(54) MICROPHONE ASSEMBLY HAVING SHIELDING FUNCTION FOR MOTOR VEHICLE

(71) Applicant: VALEO COMFORT AND DRIVING ASSISTANCE, Créteil (FR)

(72) Inventors: Stephane Schuler, Shenzhen (CN); Shuiqiang Yan, Shenzhen (CN)

( * ) Notice: Subject to any disclaimer, the term of this patent is extended or adjusted under 35 U.S.C. 154(b) by 286 days.

(21) Appl. No.: 16/633,819

(22) PCT Filed: Jul. 24, 2018

(86) PCT No.: PCT/EP2018/070057
§ 371 (c)(1),
(2) Date: Jan. 24, 2020

(87) PCT Pub. No.: WO2019/020638
PCT Pub. Date: Jan. 31, 2019

(65) Prior Publication Data

US 2020/0169799 A1 May 28, 2020

(30) Foreign Application Priority Data

Jul. 24, 2017 (CN) ..... 201710605417.4

(51) Int. Cl.
*H04R 1/08* (2006.01)
*H04R 1/04* (2006.01)
*H04R 19/04* (2006.01)

(52) U.S. Cl.
CPC ..... *H04R 1/086* (2013.01); *H04R 1/04* (2013.01); *H04R 19/04* (2013.01); *H04R 2201/003* (2013.01); *H04R 2499/13* (2013.01)

(58) Field of Classification Search
CPC ..... H04R 1/086; H04R 1/04; H04R 19/04; H04R 2201/003; H04R 2499/13; H04R 1/406; H04R 1/02; H04R 1/083
See application file for complete search history.

(56) References Cited

U.S. PATENT DOCUMENTS 8,284,966 B2 * 10/2012 Wilk ..... H04R 1/086 381/189
8,406,825 B2 * 3/2013 Huang ..... H04M 1/03 455/562.1

(Continued)

FOREIGN PATENT DOCUMENTS

CN 102395259 A * 3/2012
CN 105828226 A * 3/2012

(Continued)

OTHER PUBLICATIONS

International Search Report and Written Opinion in corresponding International Application No. PCT/EP2018/070057, dated Aug. 31, 2018 (11 pages).

(Continued)

*Primary Examiner* — Oyesola C Ojo
(74) *Attorney, Agent, or Firm* — Osha Bergman Watanabe & Burton LLP

(57) ABSTRACT

The present invention provides a microphone assembly having shielding function for a motor vehicle, comprising: a microphone circuit board having a microphone, which is supplied by a differential audio bus such that the ground potential of the microphone is floating; a cover which is located outside the microphone circuit board; a foamy part which is located between the cover and the microphone circuit board; and a shielding film which is suitable for shielding the microphone against electrostatic discharge, wherein the shielding film is located between the cover and the foamy part and covers the outer surface of the foamy part, and wherein the shielding film is electrically conductive and grounded to a vehicle chassis ground potential. In this situation, the shielding film can collect electrostatic charges and guide them to the chassis ground of the vehicle, so that electronic components on the microphone circuit board under the shielding film, especially the microphones (Continued)

having the floating ground, can be shielded from electrostatic discharge (ESD) damage. As a result, the ESD robust performance of the microphone assembly is significantly improved.

15 Claims, 12 Drawing Sheets

(56) References Cited

U.S. PATENT DOCUMENTS

| | | | | |
|---|---|---|---|---|
| 10,880,629 | B2 * | 12/2020 | Dehe | G01N 29/02 |
| 2004/0208311 | A1 * | 10/2004 | Igarashi | H04M 9/082 379/406.01 |
| 2005/0063560 | A1 | 3/2005 | Soutar et al. | |
| 2012/0027241 | A1 * | 2/2012 | Turnbull | H04R 1/086 381/361 |
| 2012/0063629 | A1 * | 3/2012 | Akino | H04R 1/086 381/355 |
| 2012/0087530 | A1 * | 4/2012 | Hawker | H04R 1/083 381/361 |
| 2013/0320465 | A1 * | 12/2013 | Huang | H04R 1/04 257/416 |
| 2020/0169818 | A1 * | 5/2020 | Rombach | H04R 1/086 |

FOREIGN PATENT DOCUMENTS

| | | | | |
|---|---|---|---|---|
| CN | 202334881 | U | | 7/2012 |
| CN | 105828226 | A | * | 8/2015 |
| CN | 105 828 226 | A | | 8/2016 |
| CN | 105828226 | A | * | 8/2016 |

OTHER PUBLICATIONS

Stockwell Elastomerics Inc: "Silicone Sponge Rubber Gaskets and Seals with Conductive Coating, for ESD Protection", Aug. 30, 2006, XP055500556, URL:http://www.stockwell.com/data-sheets/emi-conductive-coated-silicones.pdf (2 pages).

* cited by examiner

MICROPHONE ASSEMBLY HAVING SHIELDING FUNCTION FOR MOTOR VEHICLE

TECHNICAL FIELD

The present invention generally relates to a microphone assembly for a motor vehicle, and in particular to a microphone assembly having shielding function.

BACKGROUND

One or more microphones are typically mounted inside the cabin of vehicle to pick up passengers' voice signals to enable various intelligent applications such as hands-free telephone, voice recognition, and/or emergency calls. Prior arts have provided microphone assemblies that integrate microphones (e.g., MEMS microphones) into existing interior control modules of vehicle (e.g., instrument panels, central console, overhead console, etc.). The microphone integrated are in communication with a plurality of electronic devices arranged on the interior control modules.

Typically, a microphone communicates with a transceiver in differential signal, such as by means of an A2B audio bus. In this case, the transceiver responds to the electrical difference between two signals received from the microphone. Since there is no ground line in the differential signal bus, the ground of the microphone is floating, rather than electrically connecting to the vehicle chassis ground. Moreover, in order to ensure the acoustic performance, a microphone needs to be arranged as close as possible to the outer cover (less than 5 mm apart). This arrangement causes that the microphone typically becomes a weak point of electrostatic discharge (ESD). In motor vehicles, the accumulation and release of electrostatic charge due to electrostatic on human body, friction, induction, and etc. are unavoidable. Once subjected to electrostatic discharge, the ungrounded microphone may be affected. For example, the signal quality may be temporarily affected, or even the microphone may be permanently damaged. In current design of microphone assemblies for vehicles, ESD robustness is typically only a few kV, being below the automotive ESD standard of at least 15 kV.

Hence, the present invention intends to improve the ESD robustness of a microphone assembly for a motor vehicle.

SUMMARY

The present invention provides a microphone assembly having shielding function for a motor vehicle, comprising: a microphone circuit board having a microphone, which is supplied by a differential audio bus such that the ground potential of the microphone is floating; a cover which is located outside the microphone circuit board; a foamy part which is located between the cover and the microphone circuit board; and a shielding film which is suitable for shielding the microphone against electrostatic discharge, wherein the shielding film is located between the cover and the foamy part and covers the outer surface of the foamy part, and wherein the shielding film is electrically conductive and grounded to a vehicle chassis ground potential. In this situation, the shielding film can collect electrostatic charges and guide them to the chassis ground of the vehicle, so that the electronic components on the microphone circuit board under the shielding film, especially the microphones having the floating ground, can be shielded from electrostatic discharge damage, such that the ESD robust performance of the microphone assembly is significantly improved. In addition, the shielding film can also shield the microphone from electromagnetic fields.

In some embodiments, the shielding film is electrically connected to a chassis ground terminal provided on the microphone circuit board. In this situation, the shielding film can be grounded by electrically connecting to the microphone circuit board.

In some embodiments, the assembly further comprises another circuit board, and the shielding film is electrically connected to a chassis ground terminal provided on said another circuit board. In this situation, the shielding film can be grounded by electrically connecting to the said another circuit board. One example for the said another circuit board is main application circuit board, which provides power to and/or communicates with the microphone circuit board.

The present invention provides various embodiments for grounding the shielding film.

According to the first embodiment, the inner surface of the cover has an electrically conductive portion, which is electrically connected to the chassis ground terminal through a connecting member; and the outer surface of the shielding film electrically contacts the electrically conductive portion of inner surface of the cover in order to ground the shielding film. This approach eliminates the need of specifically designing the structure of the shield film or foamy part and is therefore easy to use.

Optionally, the connecting member may be an electrically conductive spring contact, which is compressively located between the cover and the microphone circuit board or said another circuit board. In addition, the inner surface of the cover may also be connected to the corresponding chassis ground terminal by bolt or the like.

According to the second embodiment, the shielding film has an extruding portion which extends beyond the foamy part and electrically connects to the chassis ground terminal provided on the microphone circuit board or said another circuit board.

Optionally, the extruding portion extends downward and backward to the inner surface of the microphone circuit board, and the end of the extruding portion is attached to a chassis ground terminal provided on the inner surface of the microphone circuit board.

Optionally, the extruding portion extends downward and forward to the outer surface of the microphone circuit board, and the end of the extruding portion is attached to a chassis ground terminal provided on the outer surface of the microphone circuit board.

Optionally, the extruding portion of the shielding film may be attached to the chassis ground terminal through an electrically conductive adhesive. In addition, the extruding portion may also be connected to the corresponding chassis ground terminal by bolt or the like.

According to the third embodiment, the assembly further comprises a rubber connector which is compressively assembled between the microphone circuit board and said another circuit board; and the extruding portion of the shielding film extends downward and backward in order to be at least partially interposed between the rubber connector and the microphone circuit board, such that the extruding portion is electrically connected to the chassis ground terminal of said another circuit board through the rubber connector. In this way, it is not necessary to make significant adjustment to the structure of the existing microphone circuit board, and thus the operation is convenient.

According to the fourth embodiment, the inner surface of the shielding film is electrically connected to the chassis ground terminal provided on the microphone circuit board through a connecting member.

Optionally, the connecting member may be an electrically conductive spring contact, which is located within a through-hole of the foamy part covered by the shielding film, and the spring contact is compressively located between the inner surface of shielding film and the microphone circuit board.

In the embodiments of the present invention, optionally, the inner surface of the cover is provided with an electrically conductive layer, which electrically connects to the outer surface of the shielding film.

Optionally, the shielding film has a mesh film structure.

Optionally, the shielding film may be glued or stuck onto the outer surface of the foamy part.

Optionally, the foamy part is provided with an acoustic hole for the microphone, and the acoustic hole is covered by the shielding film.

The present invention further provides an interior module for a motor vehicle, which comprises the microphone assembly as disclosed above.

The present invention further provides a motor vehicle comprising the interior module as disclosed above.

BRIEF DESCRIPTION OF THE DRAWINGS

The above features and advantages and other features and advantages of the present invention are apparent from the following detailed description of the best embodiments by referring the accompanying drawings.

DETAILED DESCRIPTION

Figure 1:
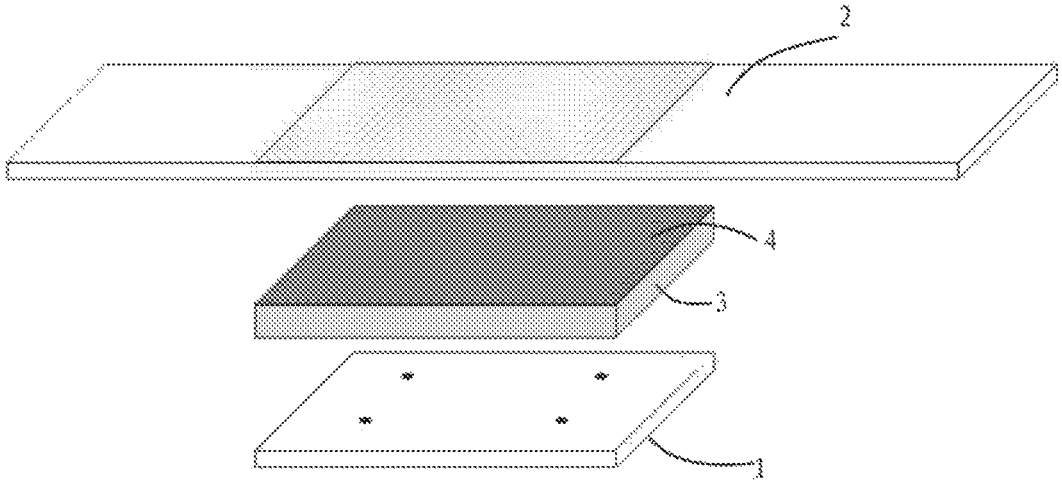
FIG. 1 is an exploded perspective view of the microphone assembly generally according to the present invention.

In the drawings and the following detailed description, the same or similar components are denoted by the same reference numerals. The drawings are intended to be illustrative of the present invention but not to limit the invention in any way. For example, the dimensions and proportions shown in the drawings do not limit the invention. Also, various features that are well known in the art are not described in detail in order to avoid obscuring the understanding of the invention.

FIG. 1 shows an overall exploded perspective view of a microphone assembly in accordance with the present invention. This assembly can be integrated into any suitable vehicle interior control module, such as an overhead console, a central console, a dashboard, and the like. As shown in FIG. 1, the microphone assembly includes a microphone circuit board 1, a cover 2, a foamy part 3, and a shielding film 4, wherein the foamy part 3 is disposed between the cover 2 and the microphone circuit board 1, and the shielding film 4 is disposed between the cover 2 and the foamy part 3. Throughout the text, the terms "outer" and "inner", "upper" and "lower", "top" and "bottom" are used to describe the relative directions, wherein "outer", "upper" and "top" refer to the direction from the microphone circuit board 1 to the cover 2 as shown in FIG. 1, and "inner", "lower" and "bottom" refer to the opposite directions thereof.

Figure 2A:
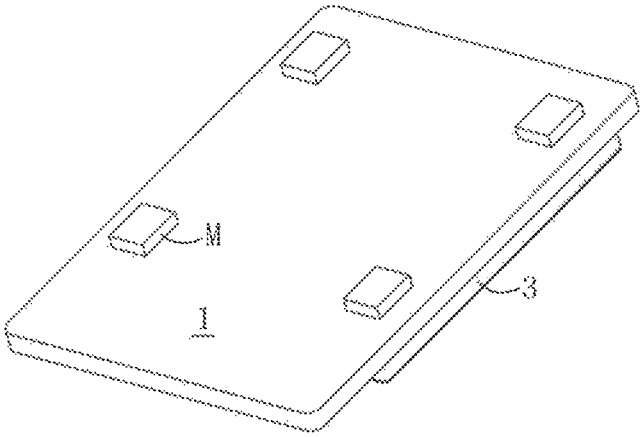
FIG. 2A is a bottom perspective view of the microphone assembly.

FIG. 2A-2D show perspective views of a microphone assembly that does not include the cover 2, in order to facilitate viewing the details of other components. The microphone circuit board 1 is a circuit board provided with one or more microphones M. In addition, a plurality of other electronic components for assisting the operation of the microphones are usually also provided on the circuit board 1. The microphone M may be a MEMS microphone unit. In practice, it is advantageous to use a microphone array consisting of multiple microphones M in order to improve background noise filtering (DSP) performance. As shown in FIG. 2A, four microphones M are disposed at four corners of the microphone circuit board 1, respectively. In addition, the microphones M may be disposed on the upper side or the lower side of the microphone circuit board 1. In the embodiment shown in FIGS. 2 and 2A, the microphones M are located on the lower side of the microphone circuit board 1. In this case, the microphone circuit board 1 is provided with acoustic holes each aligned with one microphone M to guide sound signal propagating from the upper side of microphone circuit board to the microphones M below. In the microphone circuit board 1, the microphones M communicate with a signal processing device (or transceiver) through a differential signal bus (not shown). The differential signal bus can be an A2B audio bus which does not include a ground line, such that the ground potential of the microphone M is floating instead of being common with the chassis ground potential of the vehicle.

The cover 2 is located outside the microphone circuit board 1 for protecting the microphone circuit board 1 and other components from the external environment. The cover 2 may be a molded plastic piece. The cover 2 may be the outer housing of the vehicle interior control module (as shown in FIG. 1) incorporating this microphone assembly, or the cover 2 may be a separate housing dedicated to this microphone assembly (as best shown in FIG. 3B). Optionally, the cover 2 may be provided with a mesh structure or a sound hole structure 22 corresponding to the positions of the microphones M in order to reduce the interference of the cover 2 with the microphones M. Those skilled in the art can adjust the specific structure and size of the cover 2 according to the structure and size of the actual vehicle module or microphone assembly.

Figure 2B:
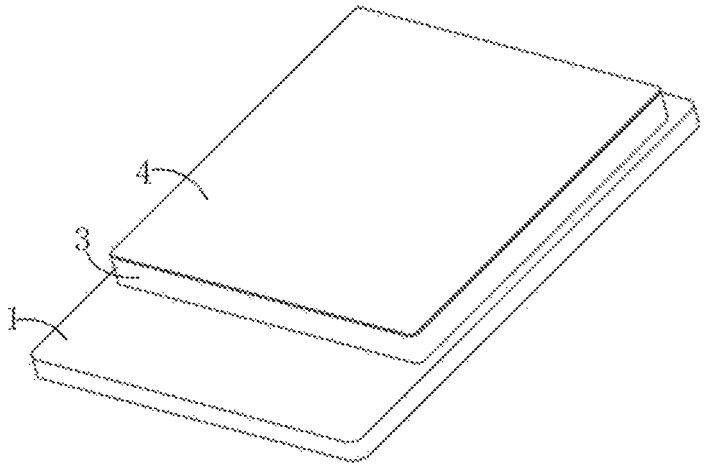
FIG. 2B is a top perspective view of the microphone assembly.
Figure 2C:
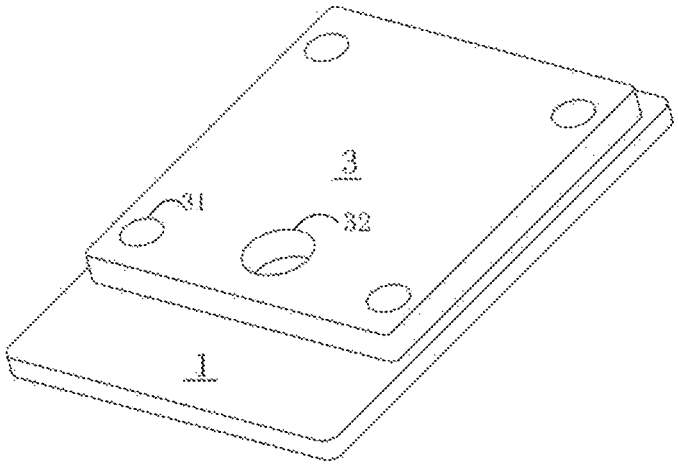
FIG. 2C is a top perspective view of the microphone assembly with the shielding film removed.

The foamy part 3 is disposed between the cover 2 and the microphone circuit board 1. The foamy part 3 is usually made of a foamy material having a porous structure. The upper and lower sides of the foamy part 3 abut against the inner surface of the cover 2 and the outer surface of the microphone circuit board 1, respectively. The foamy part 3 functions as a vibration absorbing layer to prevent the mechanical vibration in the cover 2 from propagating to the microphone circuit board 1 below, thereby ensuring the acoustic performance of the microphone M. As shown in FIG. 2C, the foamy part 3 is provided with sound holes 31, each of which is aligned with the position of each microphone M. The sound hole 31 allows sound propagating therethrough to the microphone M, while the other solid portions of the foamy part 3 can block sound from propagating to the microphone M in other directions. In this case, the foamy part 3 actually functions as an acoustic isolation layer for directionally propagating sound.

Figure 2D:
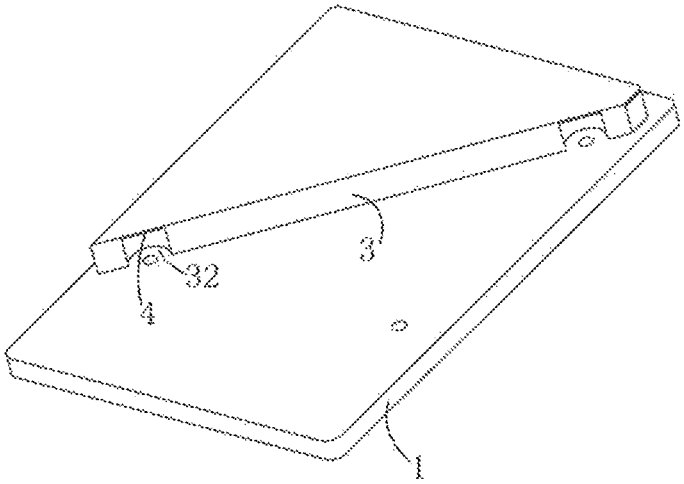
FIG. 2D is a partially cutaway perspective view of FIG. 2B.

The shielding film 4 is disposed outside the foamy part 3. As shown in FIG. 2B-2D, the shielding film 4 covers substantially all of the outer surface of the foamy part 3. In particular, the shielding film 4 covers the sound hole 31 (FIG. 2D) and other holes 32 in the foamy part 3. The shielding film 4 is electrically conductive and grounded. Specifically, the shielding film 4 is electrically connected to the chassis ground of the vehicle, and the specific grounding manner will be described in detail below. Herein, the term "chassis ground of a vehicle" means a chassis of a vehicle that provides a reference voltage for a variety of electronics in vehicle, which may be implemented as a ground terminal G that is electrically connected to the chassis of the vehicle. The shielding film 4 can be used as a current collector for the electrostatic charges and direct the electrostatic charges conducted from adjacent components or induced by external electric fields into the chassis ground of the vehicle. Thereby, the shielding film 4 can protect the electronic device on the microphone circuit board 1 from the electrostatic discharge, in particular, prevent temporary failure or permanent damage of the microphone M being as a weak point. It has been confirmed in experiments that the electrostatic discharge ESD robustness of the microphone assembly using this shielding film 4 can be increased to above 15 kV, thereby conforming to the current automotive ESD standard. ESD robustness can be at least doubled relative to the existing arrangements that do not use the electrostatic shielding film 4. In addition, the shielding film 4 can also protect the electronic device on the microphone circuit board 1 from external electromagnetic fields, and can provide other shielding effects besides the electrostatic discharge shielding. In practice, the shielding film 4 may be a mesh film woven from metal (for example, copper, aluminum) fibers. The mesh structured shielding film 4 allows sound signals passing therethrough and propagating to the microphone M below. In addition, the mesh structured shielding film 4 also blocks impurities such as dust from moving close to the microphones M. This shielding film 4 can be attached to the outer surface of the foamy part 3 with an adhesive.

In order to enable grounding, the shielding film 4 may be electrically connected to the chassis ground terminal 1G provided on the microphone circuit board 1. Additionally or alternatively, the shielding film 4 may be electrically connected to a chassis ground terminal 5G disposed on another circuit board 5. Said another circuit board 5 may be a main application circuit board 5 carrying other functions of the vehicle module. The main application circuit board 5 may be electrically coupled to the microphone circuit board 1 for power transmission and/or signal communication. It will be understood by those skilled in the art that the chassis ground terminal 1G or 5G can be disposed at any suitable position, for example, on either side of the corresponding microphone circuit board 1 or said another circuit board 5.

FIGS. 3, 4, 5 and 6 show schematic cross-sectional views of different embodiments of grounding the shielding film 4 of the microphone assembly.

Figure 3:
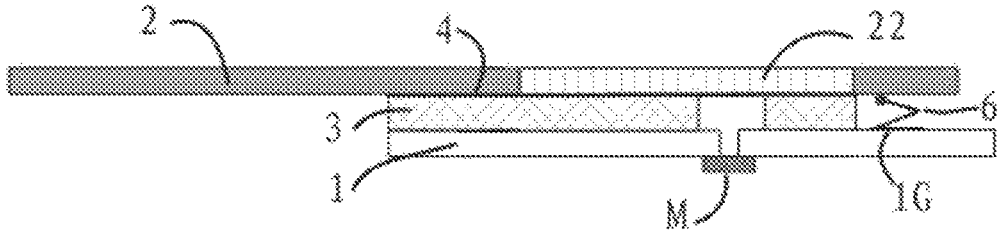
FIG. 3 is a schematic view showing the microphone assembly according to the first embodiment.
Figure 3A:
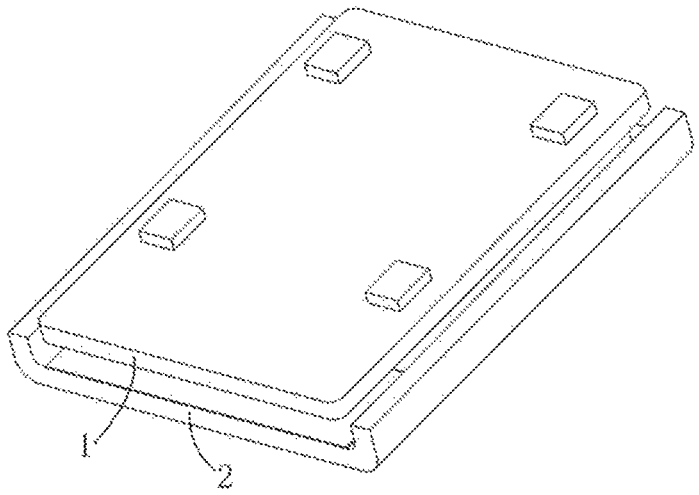
FIG. 3A is a bottom perspective view of the microphone assembly according to the first embodiment.
Figure 3B:
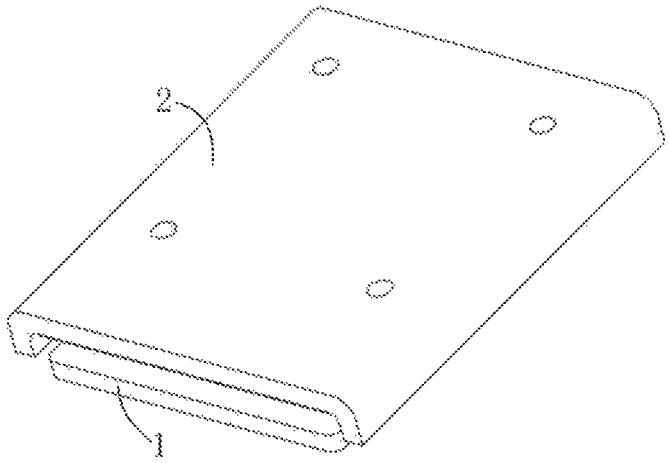
FIG. 3B is a top perspective view of the microphone assembly according to the first embodiment.

FIG. 3 shows the first embodiment, in which the inner surface of the cover 2 has a conductive portion 22, and the conductive portion 22 is grounded through a connection structure 6. The outer surface of the shielding film 4 electrically contacts the conductive portion 22 of the cover 2, thereby enabling grounding of the shielding film 4. In other words, the outer surface of the shielding film 4 is grounded by contacting the conductive inner surface of the cover 2. In one embodiment, all of the inner surfaces of the cover 2 may be electrically conductive. Alternatively, only a portion of the inner surface of the cover 2 is electrically conductive, which portion may be sufficient to cover the entire outer surface of the shielding film 4, thereby obtaining a maximum contacting area between the shielding film 4 and the cover 2. The connection structure 6 may be disposed inside or outside the area of the shielding film 4. Preferably, as shown in FIGS. 3 and 3A-3C, the connection structure 6 is disposed outside the region of the shielding film 4. In this case, the conductive portion 22 of the inner surface of the cover 2 includes a portion beyond the shielding film 4 so as to be electrically connected to the connection structure 6. In order to form the conductive portion 22 on the inner surface of the cover 2, a specific region of the inner surface of the cover 2 may be coated with a conductive paint. Alternatively, a separate conductive film may be attached to the inner surface of the cover 2 to form said conductive portion 22. Alternatively, a molded conductive metal member may be fastened to the inner surface of the cover 2. The invention is not limited to the manners listed, and other ways for forming the conductive portion 22 are readily apparent for those skilled in the art.

Figure 3C:
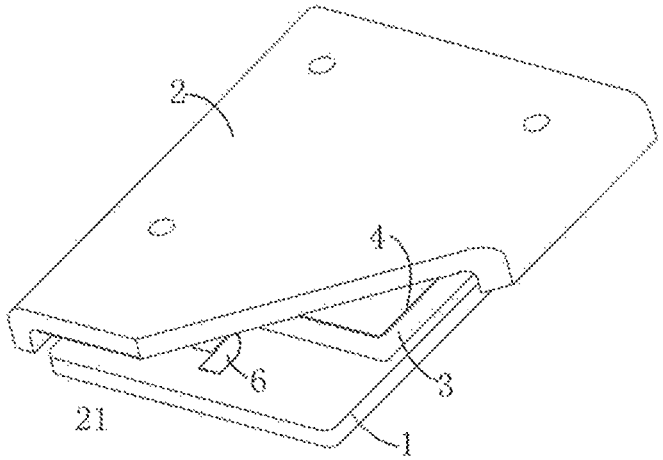
FIG. 3C is a partially cutaway perspective view of FIG. 3B.

As shown in FIGS. 3 and 3C, the connecting structure 6 may preferably be a spring contact member 6, one end of which is mounted to the upper surface of the microphone circuit board 1 and electrically connected to the chassis ground terminal 1G thereon, and the opposite end of which electrically contacts the conductive inner surface of the cover 2. In particular, the spring contact 6 is elastically compressively disposed between the cover 2 and the microphone circuit board 1, thereby contributing to a stable electrical connection therebetween. In other embodiments, the connecting structure 6 may be a structure other than a spring, such as an electrical connection wire, a bolt, a buckle, or the like. In another embodiment not shown, the electrically conductive inner surface of the cover 2 can also be electrically connected to a chassis ground terminal 5G located on the upper surface of the main application circuit board 5. In this situation, the spring contact 6 may be elastically compressively arranged between the electrically conductive inner surface of the cover 2 and the circuit board 5.

Figure 4:
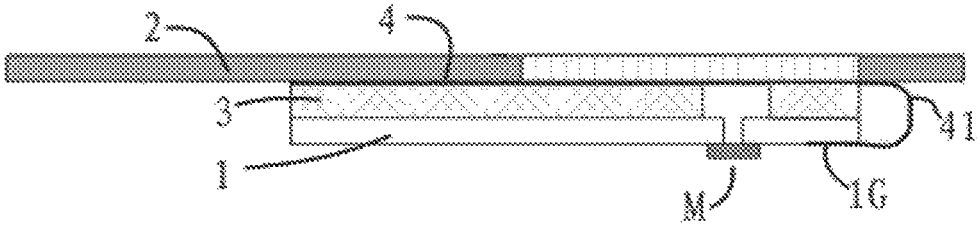
FIG. 4 is a schematic view showing the microphone assembly according to the second embodiment.

FIG. 4 shows a second embodiment in which the shielding film 4 has an extruding portion 41 extending beyond the foamy part 3. The extruding portion 41 is to be grounded. Specifically, the extruding portion 41 may be electrically connected to a chassis ground terminal 1G/5G located on the lower surface or upper surface of the microphone circuit board 1 or the main application circuit board 5.

Figure 4A:
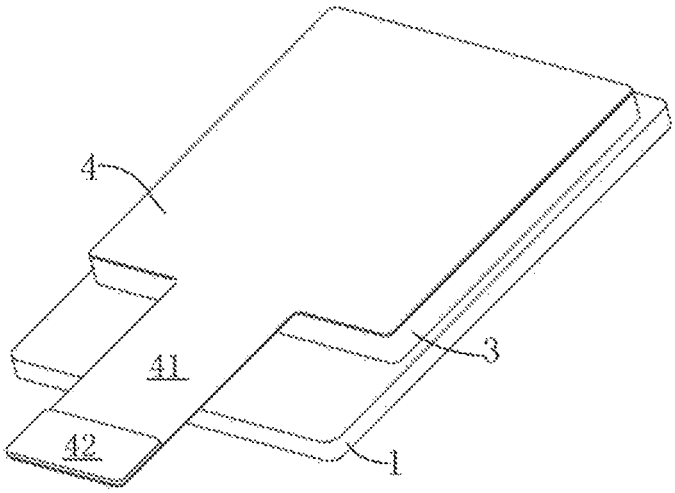
FIG. 4A is a top perspective view of the microphone assembly according to the second embodiment.
Figure 4B:
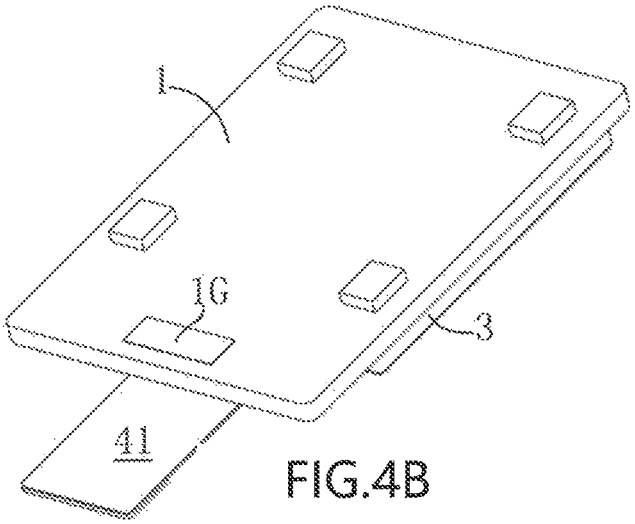
FIG. 4B is a bottom perspective view of the microphone assembly showing a protruding portion of the shielding film being ungrounded.
Figure 4C:
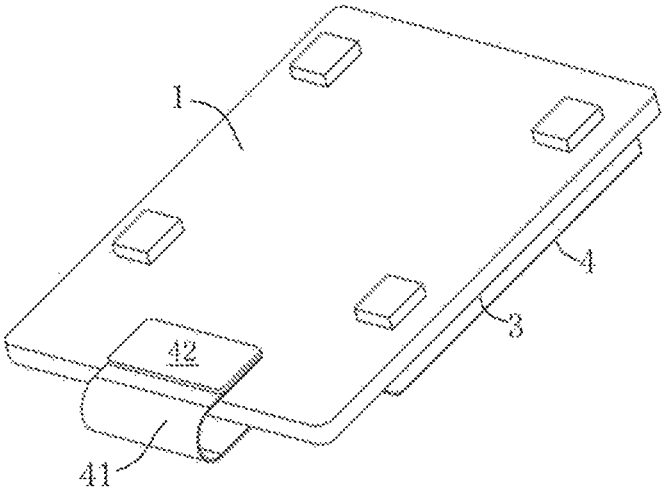
FIG. 4C is a bottom perspective view of the microphone assembly showing a protruding portion of the shielding film being grounded on the inner surface the microphone circuit board.

FIG. 4A-4C show an embodiment in which the extruding portion 41 of the shielding film 4 has a strip shape whose length is adapted to extend downward and backward to the inner/lower surface of the microphone circuit board 1, and to mate with the ground terminal 1G formed on the inner surface of the microphone circuit board 1. As shown, the end 42 of the extruding portion 41 is able to be bonded to the ground terminal 1G by a conductive adhesive.

Figure 4D:
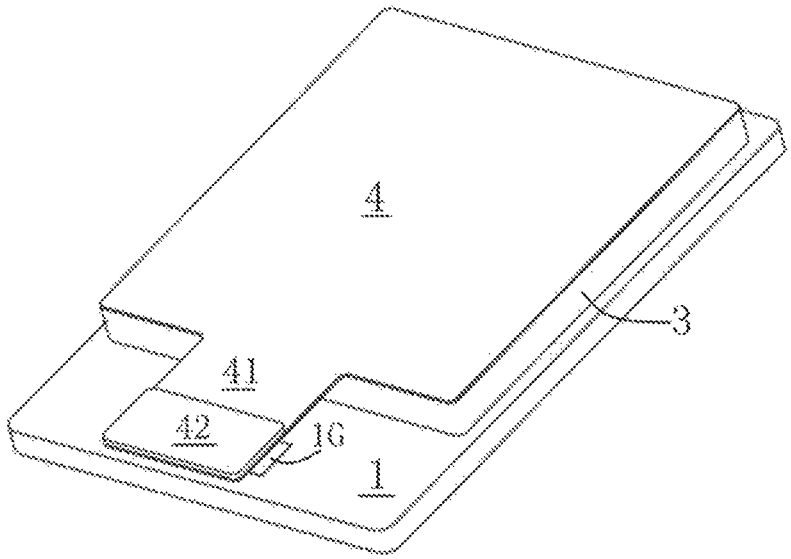
FIG. 4D is a top perspective view of the microphone assembly showing a protruding portion of the shielding film being ungrounded.
Figure 4E:
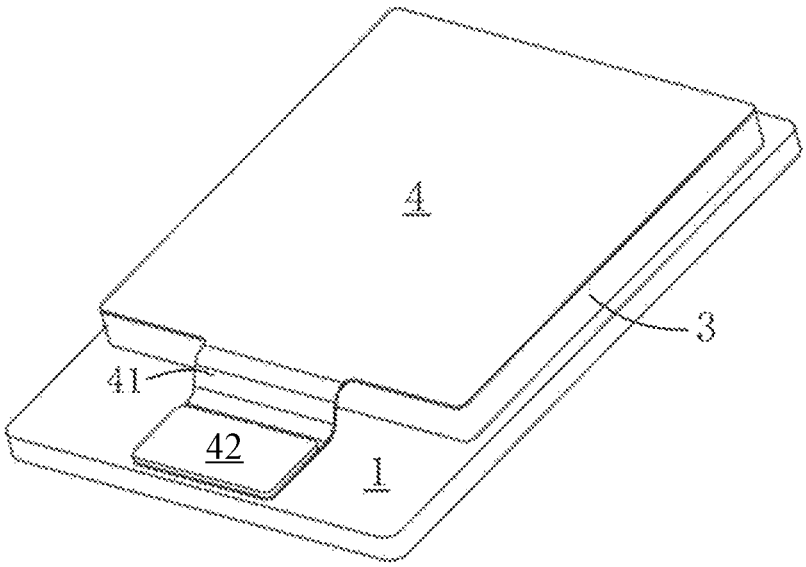
FIG. 4E is a top perspective view of the microphone assembly showing a protruding portion of the shielding film being grounded on the outer surface of the microphone circuit board.

FIGS. 4D-4E illustrate another embodiment in which the length of the extruding portion 41 of the shielding film 4 is shortened compared to the previous embodiment. In particular, the length of the extruding portion 41 is adapted to extend downwardly and forwardly to the upper/outer surface of the microphone circuit board , where the extruding portion 41 mates with the ground terminal 1G on the upper surface of the microphone circuit board 1. Similarly, the end 42 of the extruding portion 41 is also able to be bonded to the ground terminal 1G by a conductive adhesive.

As shown, a support member may be provided on the outer surface of the end 42 of the extruding portion 41. The support member may be a metal sheet having a rigidity greater than that of the shielding film 4, so that the end 42 can be easily displaced, attached, or the like.

In other embodiments, the extruding portion 41 can also be attached to the circuit board in a manner other than conductive adhesive, such as a screw, a bolt or the like. In addition, the extruding portion 41 may also possible to extend to electrically connect the ground terminal 5G on the main application circuit board 5 below the microphone circuit board 1. The person skilled in the art can adjust the shape, size, attachment manner, and the like of the extruding portion 41 according to the specific structure and size of the microphone assembly.

Figure 5:
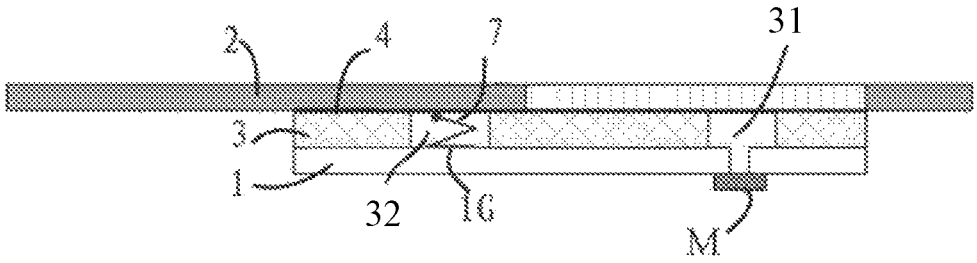
FIG. 5 is a schematic view showing the microphone assembly according to the third embodiment.
Figure 5A:
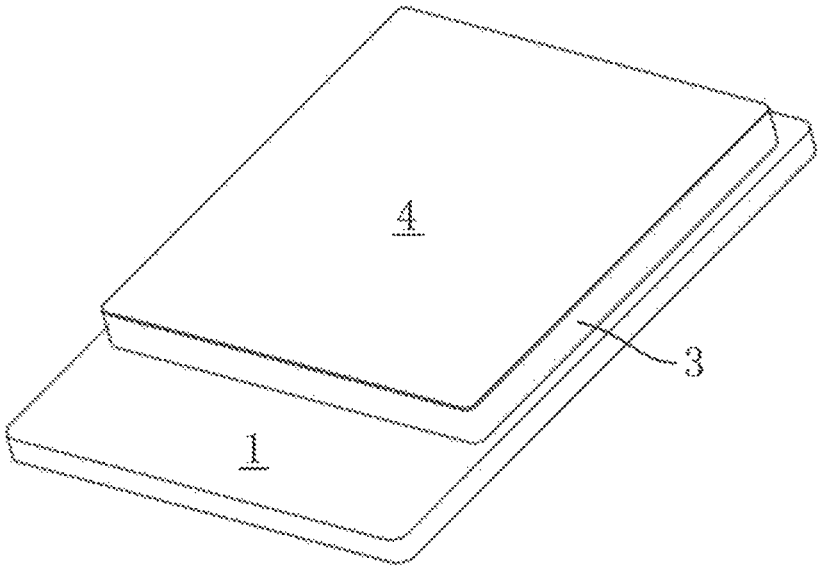
FIG. 5A is a top perspective view of the microphone assembly according to the third embodiment.

FIG. 5 shows a third embodiment in which the inner surface of the shielding film 4 is electrically connected to the chassis ground terminal 1G on the upper surface of the microphone circuit board 1 through a connecting member 7. Herein, the connecting member 7 is disposed within the foamy part 3. As shown in FIG. 5, for example, the connecting member 7 can be housed in a through hole 32 of the foamy part 3. The through hole 32 is also covered by the shielding film 4 as mentioned above. Since the connecting structure 7 is disposed within the foamy part 4, this arrangement does not result in a significant change in the appearance of the microphone assembly, as shown in FIG. 5A.

Figure 5B:
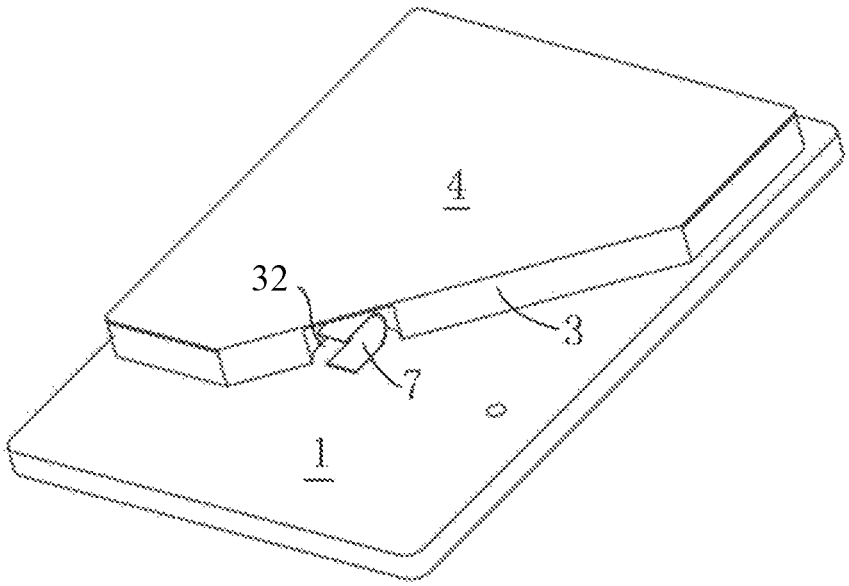
FIG. 5B is a partially cutaway perspective view of FIG. 5A.

Specifically, as shown in FIG. 5B, the connecting member 7 may be a spring contact 7.

The spring contact 7 is located in the through hole 32 of the foamy part 3, and the lower end thereof is mounted on the microphone circuit board 1 and electrically connected to the ground terminal 1G. The upper end of the spring contact 7 abuts against the inner surface of the shielding film 4. The spring contact 7 is elastically compressively arranged between the shielding film 4 and the microphone circuit board 1 to achieve a stable electrical connection. In the microphone assembly, the inner surface of the cover 2 is pressed against the shielding film 4 from the upper side, which in turn ensures that the spring contact 7 below the shielding film 4 is stably placed in position.

Although the illustrated example shows that the connecting member 7 is a spring contact 7, the present invention is not limited thereto, and other structures may be employed, such as an elastic rubber electrical connector separate or integral with the foamy part 3, or a bolt assembly simultaneously connected to the shielding film 4 and the microphone circuit board 1, and the like.

Figure 6:
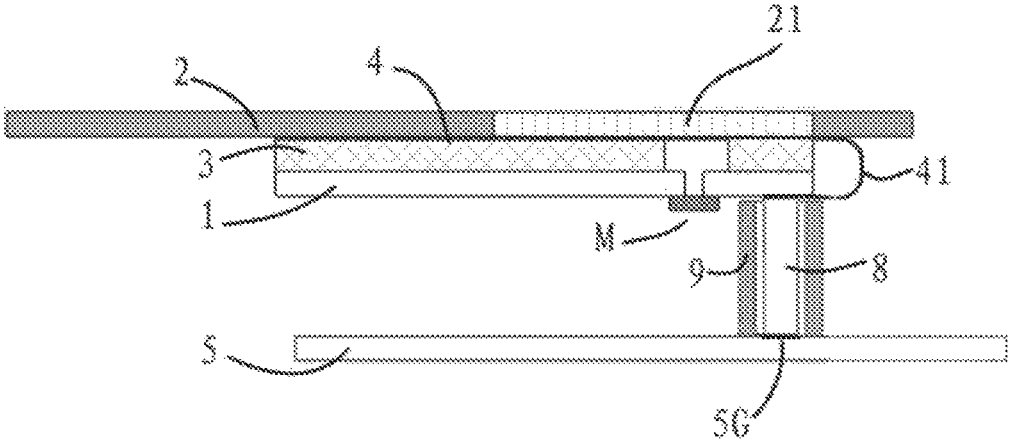
FIG. 6 is a schematic view showing the microphone assembly according to the fourth embodiment.

FIG. 6 shows a fourth embodiment in which the shielding film 4 has an extruding portion 41 similar to the second embodiment as described above. The extruding portion 41 is bent downward and backward to the inner surface of the microphone circuit board 1 with its end 42 being located on the lower side of the microphone circuit board 1. The difference is that the end 42 herein is connected to the ground terminal 5G on the main application circuit board 5 below through a rubber electrical connector 8.

This kind of rubber electrical connector used in a microphone assembly has been disclosed in Chinese patent application CN201710266229.3, which is entirely incorporated herein by reference. Such rubber connector comprises staggered conductive strips and insulating strips. The pitch of the conductive strips is arranged to effectively electrically connect corresponding terminals on two opposite circuit boards, thereby implementing interconnection between two circuit boards face-to-face. The rubber connector is typically elastically compressively disposed between two circuit boards to achieve a stable electrical connection, and isolate mechanical vibrations from propagating between the boards at same time.

Figure 6A:
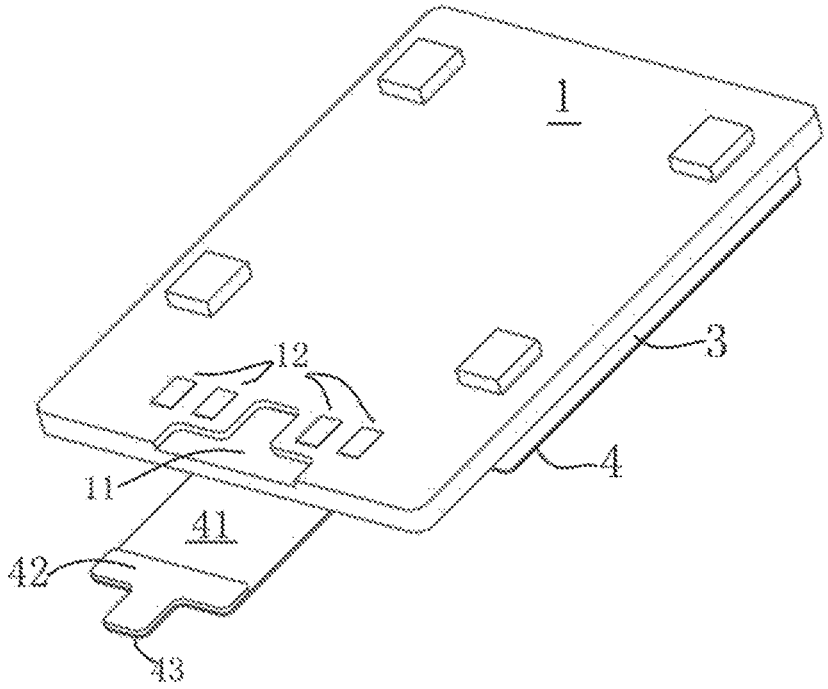
FIG. 6A is a bottom perspective view of the microphone assembly according to the fourth embodiment, showing the extruding portion of the shielding portion is not connected to the microphone circuit board.
Figure 6B:
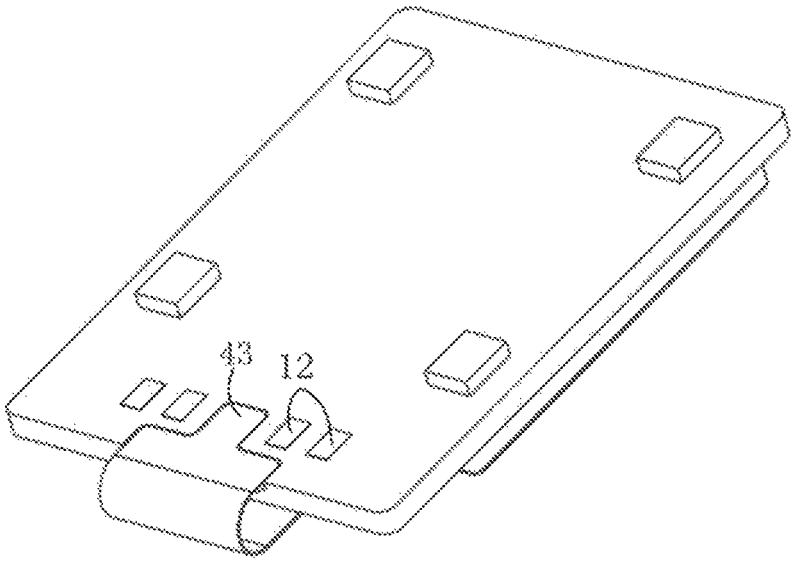
FIG. 6B is another bottom perspective view of the microphone assembly according to the fourth embodiment, showing the extruding portion of the shielding portion has been connected to the microphone circuit board.
Figure 6C:
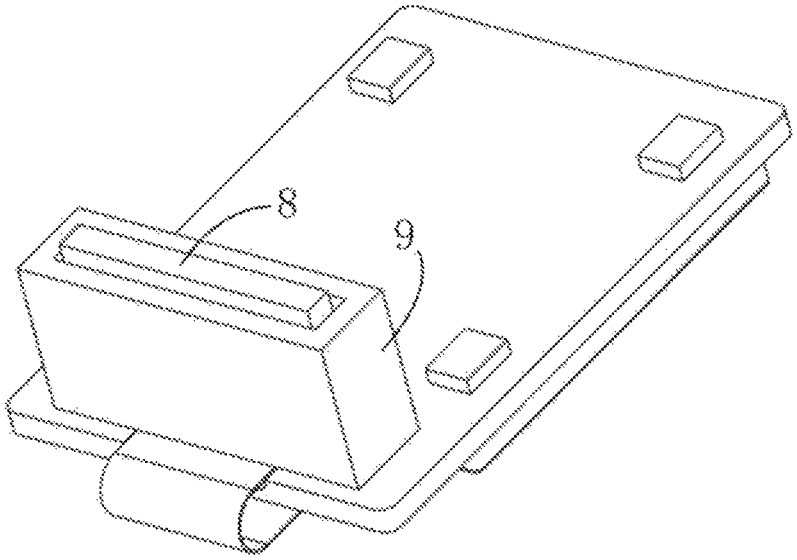
FIG. 6C is yet another bottom perspective view of the microphone assembly according to the fourth embodiment, showing a rubber connector has been connected to the microphone circuit board.
Figure 6D:
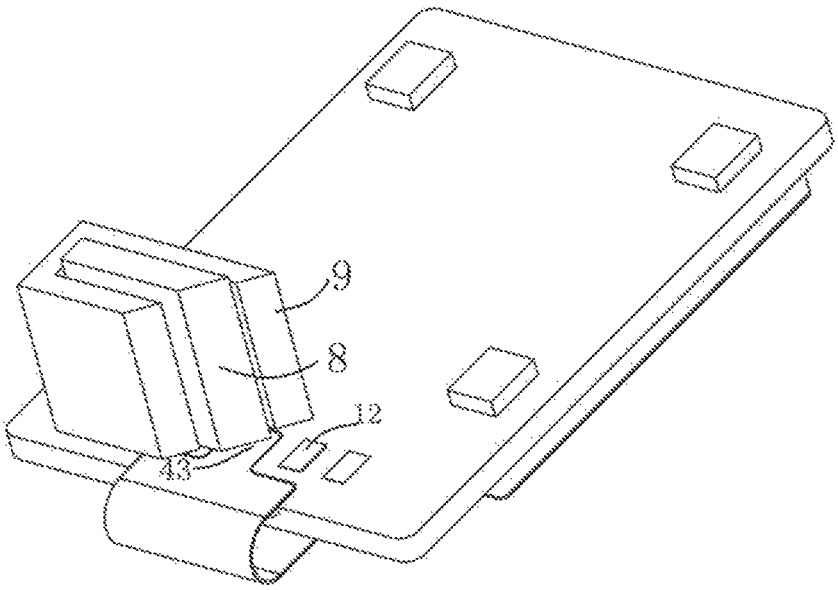
FIG. 6D is a partially cutaway perspective view of FIG. 6C.

As shown in FIG. 6A, the end 42 of the extruding portion 41 has a projection 43. When the extruding portion 41 is placed in position, the projection 43 and the exposed terminals 12 on the microphone circuit board 1 are arranged side by side so as to form an array for mating with the conductive strips in the rubber connector 8. In other words, the pitch in the array including the projection 43 is consistent with the pitch of conductive strips in the rubber connector 8. In addition, the end 42 can also be provided with a support such as a metal sheet for supporting the relatively soft extruding portion 41. In this case, a recess matching with the shape of the end 42 may be provided inside the microphone circuit board 1, as best shown in FIG. 6A. When the end 42 is disposed within the recess, the projection 43 is placed in position, and the surface of the end 42 is flush with the surface of the microphone circuit board 1, as shown in FIG. 6B. This facilitates an efficient and stable electrical connection through the rubber connector 8. Subsequently, a rubber connector 8 and housing 9 are arranged such that one end of the rubber connector 8 contacts the extruding portion 41 of the shielding film 4 (as shown in FIG. 6D), with the other end of the rubber connector 8 contacting the main application circuit board 5. As a result, the shielding film 4 is electrically connected to the ground terminal 5G on the main application circuit board 5 through the rubber connector 8 (as shown in FIG. 6).

In the first embodiment described above, it is disclosed that the cover 2 has an electrically conductive inner surface portion. However, in the second, third and fourth embodiments described above, it is also possible to provide the cover 2 with same conductive inner surface portion being in electrical contact with the outer surface of the shielding film 4. In this case, the conductive inner surface portion of the cover 2 can also serve as a current collector for electrostatic charge and conduct electrostatic charge to the shielding film 4, thereby enhancing the ESD shielding effect of the microphone assembly. Additionally or alternatively, another electrically conductive layer may also be disposed between the shielding film 4 and the cover 2 to further enhance the shielding effect.

In another aspect of the invention, a vehicle interior module including the aforementioned microphone assembly is provided. The vehicle interior module is, for example, an overhead console, a central console, a rear view mirror, a dashboard, and the like. This interior module integrates a microphone function so as to capture passengers' voice. By virtue of the shielding film as disclosed above grounding to the vehicle chassis ground, the microphone unit in the interior module exhibits a high ESD robustness, and is capable of withstanding higher voltage electrostatic discharge.

In yet another aspect of the present invention, a motor vehicle including the aforementioned vehicle interior module is provided. This motor vehicle can implement a microphone function inside the cabin, which microphone function can withstand a higher voltage of electrostatic discharge.

Although the invention has been described with reference to a limited number of embodiments, it is understood that some other embodiments of the invention may be devised by those skilled under the teaching of the present disclosure without departing from the scope of the invention disclosed herein. Therefore, the scope of the invention is limited merely by the appended claims.

The invention claimed is:

1. A microphone assembly having shielding function for a motor vehicle, comprising:

a microphone circuit board having a microphone, which is supplied by a differential audio bus such that the ground potential of the microphone is floating;

a cover which is located outside the microphone circuit board;

a foamy part which is located between the cover and the microphone circuit board; and a shielding film for shielding the microphone against electrostatic discharge, wherein the shielding film is located between the cover and the foamy part and covers the outer surface of the foamy part, and wherein the shielding film is electrically conductive and grounded to a vehicle chassis ground potential, and wherein the inner surface of the shielding film is electrically connected to the vehicle chassis ground through a ground terminal provided on the microphone circuit board through a connecting member, and wherein the connecting member is an electrically conductive spring contact, which is located within a through-hole of the foamy part covered by the shielding film, and wherein the spring contact is compressively located between the inner surface of shielding film and the microphone circuit board.

2. The microphone assembly according to claim 1, further comprising another circuit board, wherein the shielding film is electrically connected to a chassis ground terminal provided on said another circuit board.

3. The microphone assembly according to claim 1, wherein the inner surface of the cover has an electrically conductive portion, which is electrically connected to the chassis ground terminal through a connecting member, and wherein the outer surface of the shielding film electrically contacts the electrically conductive portion of inner surface of the cover in order to ground the shielding film.

4. The microphone assembly according to claim 3, wherein the connecting member is an electrically conductive spring contact, which is compressively located between the cover and the microphone circuit board or said another circuit board.

5. The microphone assembly according to claim 1, wherein the shielding film has an extruding portion, which extends beyond the foamy part and electrically connects to the chassis ground terminal provided on the microphone circuit board or said another circuit board.

6. The microphone assembly according to claim 5, wherein the extruding portion extends downward and backward to the inner surface of the microphone circuit board, and wherein the end of the extruding portion is attached to a chassis ground terminal provided on the inner surface of the microphone circuit board.

7. The microphone assembly according to claim 5, wherein the extruding portion extends downward and forward to the outer surface of the microphone circuit board, and wherein the end of the extruding portion is attached to a chassis ground terminal provided on the outer surface of the microphone circuit board.

8. The microphone assembly according to claim 5, wherein the extruding portion of the shielding film is attached to the chassis ground terminal through an electrically conductive adhesive.

9. The microphone assembly according to claim 5, further comprising a rubber connector which is compressively assembled between the microphone circuit board and said another circuit board, wherein the extruding portion of the shielding film extends downward and backward in order to be at least partially interposed between the rubber connector and the microphone circuit board, such that the extruding portion is electrically connected to the chassis ground terminal of said another circuit board through the rubber connector.

10. The microphone assembly according to claim 1, wherein the inner surface of the cover is provided with an electrically conductive layer, which electrically connects to the outer surface of the shielding film.

11. The microphone assembly according to claim 1, wherein the shielding film has a mesh film structure.

12. The microphone assembly according to claim 1, wherein the shielding film is glued or stuck onto the outer surface of the foamy part.

13. The microphone assembly according to claim 1, wherein the foamy part is provided with an acoustic hole for the microphone, and the acoustic hole is covered by the shielding film.

14. An interior module for a motor vehicle, comprising the microphone assembly according to claim 1.

15. A motor vehicle comprising the interior module according to claim 14.

* * * * *